United States Patent [19]

Doughty

[11] Patent Number: 4,574,613

[45] Date of Patent: Mar. 11, 1986

[54] VERSATILE LIGHTWEIGHT POWER POST

[76] Inventor: Michael E. Doughty, 4222 St. Clair Ave., Studio City, Calif. 91604

[21] Appl. No.: 607,203

[22] Filed: May 4, 1984

[51] Int. Cl.[4] ..... B21D 1/12

[52] U.S. Cl. ..... 72/447; 72/705

[58] Field of Search ..... 72/447, 705

[56] References Cited

U.S. PATENT DOCUMENTS

| | | | |
|---|---|---|---|
| 3,589,680 | 6/1971 | Kuhn | 72/705 |
| 3,612,482 | 10/1971 | Eck | 72/705 |
| 3,698,230 | 10/1972 | Buske | 72/705 |
| 3,796,084 | 3/1974 | Jarman | 72/705 |
| 3,955,397 | 5/1976 | Meis | 72/705 |
| 4,158,303 | 6/1979 | Horn et al. | 72/705 |

*Primary Examiner*—Lowell A. Larson

*Attorney, Agent, or Firm*—Poms, Smith, Lande & Rose

[57] ABSTRACT

A powerful and versatile lightweight power post system for the repair of "unibody", or unitary body and frame type automobiles. The basic post is of relatively lightweight tubular construction and has a small base for holding it erect. An elongated power assembly which is tubular and fits over the post is movably mounted at the upper end of the post by a winch which is mounted on the power assembly. Toward the bottom of the power assembly is the main power pulley, and at the upper end of the power assembly is a pivotally mounted power arm. A powerful hydraulic ram extends from the lower end of the elongated power assembly near the main pulley outwardly from the post to a point on the pulling arm spaced well away from the main post. An additional pulley may be mounted on the upper pulling arm between the mounting point for the hydraulic ram and the post. A lower pulley is mounted on the post on a slider assembly to provide a versatile second pull. On the other side of the post and secured to the lower end of the power assembly and to the lower slider assembly, respectively, are loops to receive a single equalized back chain. Chain locks are provided for selective pull coupling. Lifting arrangements may be provided at the outer end of the pulling arm.

16 Claims, 11 Drawing Figures

130
132
124
126
128
24
52
40
42
18
54-1
102
106
104
16
14
58
56
110
120
118
62
VI
50
52
38
108
46
48
34
116
26
32
30
36
66
142
68
114

VERSATILE LIGHTWEIGHT POWER POST

FIELD OF THE INVENTION

This invention relates to so-called "power posts" employed in the repair of automobiles which have been damaged.

BACKGROUND OF THE INVENTION

In the late 1970's or early 1980's U.S. automobile manufacturers switched over to "unibody" type construction where the prior practice of having a massive automobile frame, and a separate lighter weight automobile body secured to the frame was discontinued. Instead, a "unitary body and frame" construction started to be used in the manufacture of American cars. This type of automobile construction technique had previously been used in Europe; and accordingly, many so-called "bench" systems were imported from Europe for the purposes of repairing damaged vehicles. These bench systems were and are massive, and involve the steps of holding or clamping the vehicle, measuring the departures from desired locations of the deformed parts, and applying restoring forces to bring the parts back to their original relative locations. However, many garages in the United States had floor anchor tie-down "pots" which they had previously been using for the repair of vehicles. Accordingly, the costly investment in the European type bench systems would have constituted an additional and duplicate expense.

Accordingly, one object of the present invention is to provide a viable alternative to the European bench systems, and one which would permit the use of pre-existing floor anchor tie-down pots or the like.

From another standpoint, the prior art includes various automobile repair tools such as those shown in G. N. Chartier, U.S. Pat. No. 3,340,720, and L. Eck, U.S. Pat. No. 3,338,083. These are relatively massive and elaborate systems for repairing damaged automobiles. Certain simpler types of power posts are also known, see W. K. Haggarty, U.S. Pat. No. 3,566,667 granted Mar. 2, 1971; however, these have generally been relatively limited in their functions and capability.

From a broader aspect, therefore, an important object of the present invention is to provide a relatively lightweight power post, which is compatible with the tie-down arrangements included in many garages or automobile repair facilities, and which also has the capability of providing multiple pulls and the flexibility of controlling these various pulls, without the need for the elaborate bench-type European equipment which is exceedingly massive, heavy, and expensive.

SUMMARY OF THE INVENTION

In accordance with the power post system of the present invention, a relatively light main support post is provided with (1) a base for holding the post erect, (2) an elongated power assembly, or upper slider, of hollow construction movably mounted on the upper portion of the support post, with the power assembly including a main pulley mounted toward the lower end thereof, a pivoted pulling arm mounted near the upper end thereof, and a hydraulic ram coupled from the lower end of the power assembly and extending outwardly from the post to a point on the pulling arm spaced well away from the post, and an upper pulley secured to the pulling arm between the main post and the ram coupling point, and (3) a lower pulley and slider assembly mounted on the post below the power assembly and including a third pulley. In addition, chains are provided for providing at least two distinct pulls over the main pulley and the lower pulley, and arrangements are provided for applying these pulls to a damaged automobile to be repaired, either concurrently, successively, or with varying powers applied to the two chains.

Other features or aspects of the invention may selectively include the following:

1. The power arm may include lifting arrangements, out away from the post beyond the hydraulic ram coupling point, to provide a vertical lift capability.

2. A winch may be mounted on the power assembly to raise and lower it on the post to substantially any desired position or elevation of the main pulley and/or the pulling arm.

3. Chain locks and chain lock securing or mounting arrangements are provided at both the main pulley and the lower pulley, as well as on the pulling arm, so that a plurality of chain pulls may be controlled, maintained, and alternated, or accomplished in unison, in accordance with the needs of the work being performed.

4. At the lower end of the elongated power assembly, and on the lower pulley slider, on the side away from the pulleys, coupling points are provided for back chains, to secure the post assembly to two anchor pots. In order to equalize the forces at both the main pulley and the lower pulley points along the post, essentially a single loop of chain is coupled from one of two floor anchor pots, through one of the coupling points on the power post, back to a coupling point or metal loop secured to a second floor anchor, then up to the second coupling point on the post, and finally back to the first coupling point at the first floor anchor point. By using a single length of chain to interconnect the two floor anchor points and the two post coupling points, automatic equalization is obtained.

Other objects, features and advantages of the invention will become apparent from a consideration of the detailed description and from the accompanying drawings.

DETAILED DESCRIPTION

Figure 1:
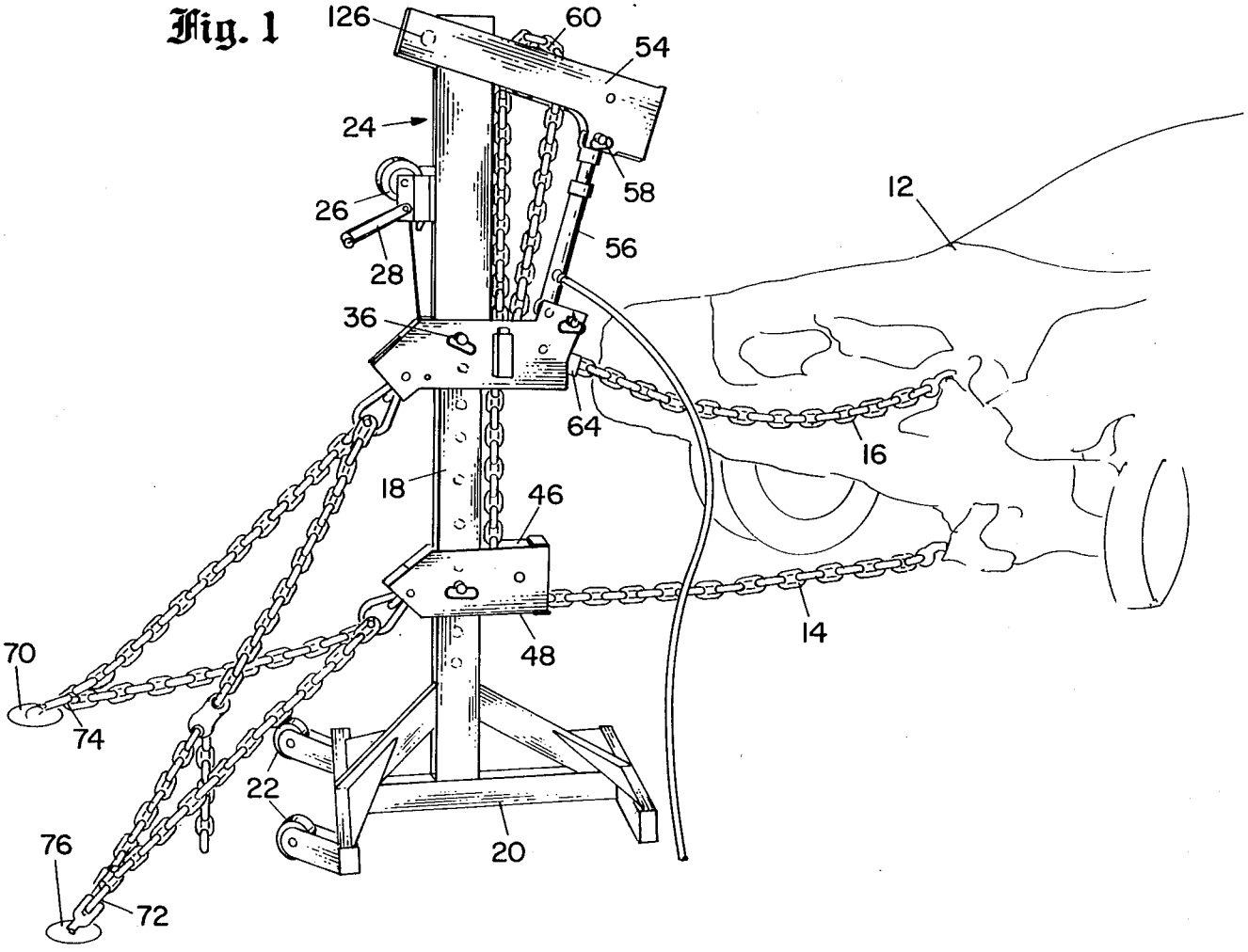
FIG. 1 is an overall view illustrating the principles of the invention as applied to an actual physical arrangement wherein a wrecked automobile is being repaired.

Referring more particularly to the drawings, FIG. 1 shows a damaged vehicle 12 to which a pair of chains 14 and 16 are attached for the purposes of straightening out some portions of the damaged vehicle. The apparatus of the present invention which is shown centrally in FIG. 1 includes the main vertical post 18 which is a hollow tubular member, and a base 20 which serves to hold the post 18 erect. Wheels 22 may be employed to roll the post assembly around to a new desired location preparatory to putting it into operation. Toward the upper portion of the post 18 is mounted an elongated power assembly 24 of hollow construction which is movably mounted on the support post under the control of a winch 26 which is provided with an operating handle 28.

Figures 2, 6, 7:
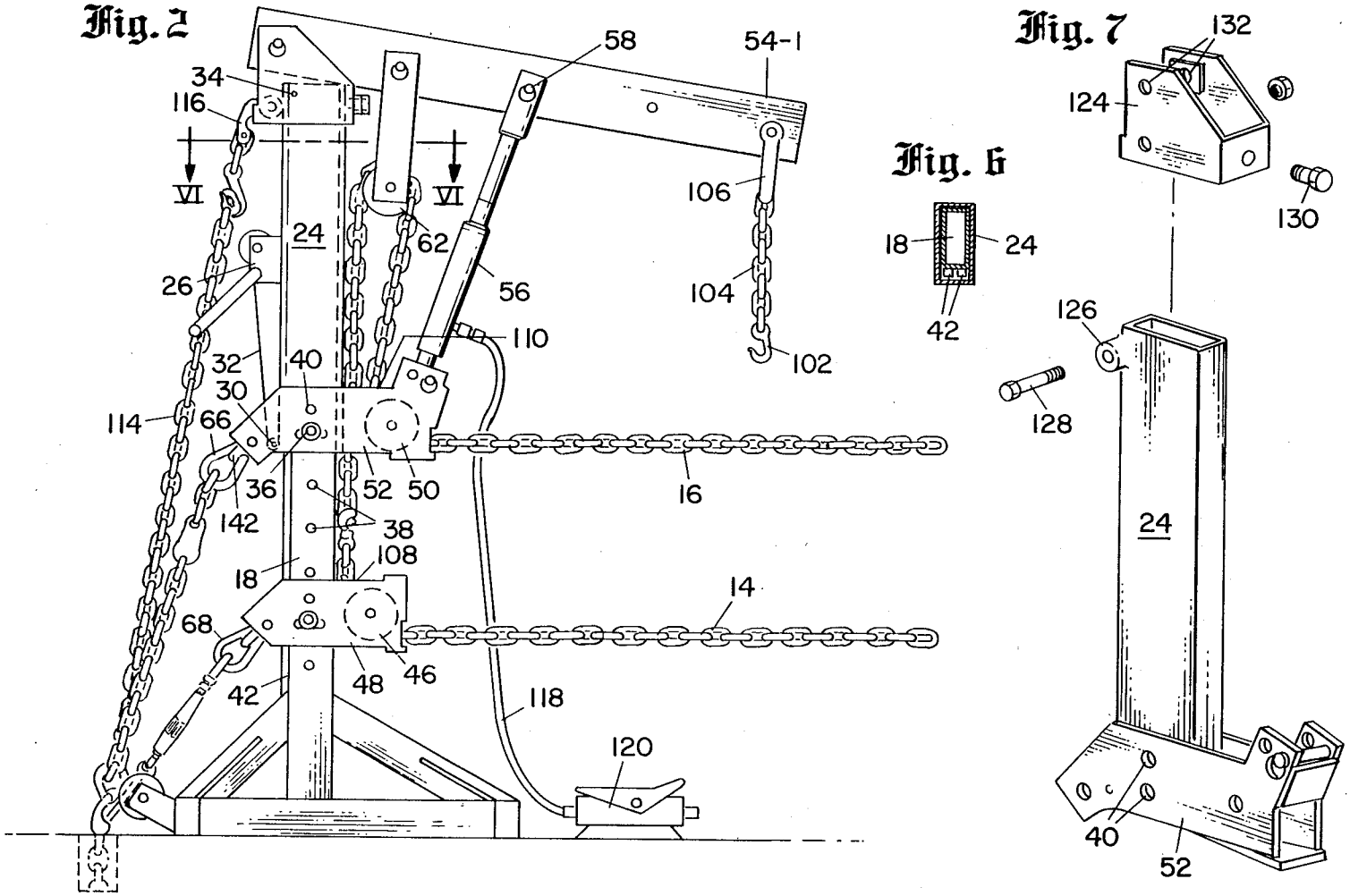
FIG. 2 is a diagram illustrating a three-pull mode involving the principles of the present invention.
FIG. 6 is a cross-sectional view taken along lines VI—VI of FIG. 2.
FIG. 7 is an isometric view of a portion of the power assembly.

The winch 26 is mounted on the power assembly 24 and operates in conjunction with a pulley 30 mounted on assembly 24, and which is best shown in FIG. 2 and a wire cable 32 which is fixed to the top of post 18 at point 34. Accordingly, when the winch 26 is operated, the force applied through pulley 30 to the assembly 24 raises the assembly 24 to the desired location. A massive height pin 36 is then inserted through matching holes in the assembly 24 and the main post 18 to firmly hold the power assembly 24 at the desired elevation. To provide reasonable flexibility in the location of the assembly 24 on the post 18, the holes 38 in the main post are on 4-inch centers, while two holes 40 are spaced apart by two inches, thus permitting the fixing of the power assembly 24 at successive two-inch increments on the post 18. At the rear of the post 18, a pair of metal strips 42 are provided, to give clearance for the wire 32 which is operated by the winch 26, and to engage the inside of the assembly 24, as shown for example, in FIG. 6.

In operation, the chains 14 and 16 extend, respectively, over the lower pulley 46 mounted in the lower slider assembly 48, and over the main pulley 50 mounted in the bracket 52 forming part of the power assembly 24. Pivotally mounted toward the top of and forming part of the power assembly 24 is the pulling arm 54 as shown in FIG. 1, or the extended pulling arm 54-1 as shown in FIG. 2. A hydraulic ram 56 which may have a 6-inch stroke and be capable of providing a force of 10 tons, is connected between the lower end of the power assembly 24 near the pulley 50, and extends outwardly from the post 24 to a coupling point 58 on the pulling arm 54 or 54-1, substantially away from the upper end of the post 18. A chain pulley 60, as shown in FIG. 1 or 62 as shown in FIG. 2 may be secured to the pulling arm between the point 58 and the main post 18. Accordingly, when the hydraulic ram 56 is actuated, and the pulling arm 54 is raised, the pulley 60 or 62, as the case may be, moves upwardly and force is applied to chains 14 and 16.

Figure 11:
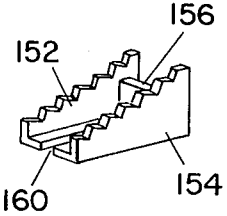
FIGS. 10 and 11 are different views of chain lock members which may be employed in combination with the present invention to block movement of chains, and control the pulls provided by the hydraulic ram.
Figure 10:
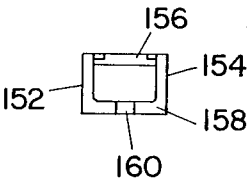

FIG. 2 shows the chains 14 and 16 both taut, with pulling pressure being applied by the ram 56 through the pulley 62 to both of chains 14 and 16. On the other hand, in FIG. 1, a chain lock 64 has isolated the chain 16, and prevents the application of any force to chain 16. Under these conditions, when the hydraulic ram 56 is actuated, the force from the movement of pulling arm 54 is transmitted along a chain 14 over the lower pulley 46 and pulls the lower chain 14 taut while the upper chain 16 remains slack. Incidentally, the construction of the chain locks is shown in FIGS. 10 and 11 of the drawings, to be discussed below.

On the side of the post 18 away from the pulleys 50 and 46, are secured metal loops 66 and 68, with metal loop 66 being secured to the bottom of power assembly 24, and the metal loop 68 being secured to the back of the bracket 48. Two tie-down anchors or pots 70 and 72, as shown in FIG. 1, are provided with associated metal loops 74 and 76, respectively. In order to equalize the forces at the support loops 66 and 68, a single chain is looped through all of the metal loops 66, 68, 74 and 76, as shown in FIG. 1. With the chain merely looped through these metal loops as shown, the chain may shift or be shifted by a few links, in order to provide an equalization of the forces. In addition, the arrangement shown in FIG. 1, with support being provided opposite the main pulley 50, as well as opposite the lower pulley 46, the entire apparatus of the present invention can be made of relatively lighter gauge and less massive material, than if this localized support were not provided along the post where needed, opposite to the main power pulley and the lower power pulley.

Incidentally, the structure of the tie-downs 70 and 72 are known per se, and they are normally implemented by a cylindrical member which is fitted down into a bored hole in a concrete slab, which may be 3 or 4 inches in diameter, with arrangements being provided to have the lower end of the cylinder slotted, and to have a tapered element fitting into the cylinder from below. This lower tapered element may be an expander wedge casting, which is provided with slots for firm retention of the end of a chain. When these floor tie-downs are not in use, the chain may be stored within the cylindrical can, and a cover placed over the units so they are substantially flush with the garage floor.

Figure 5:
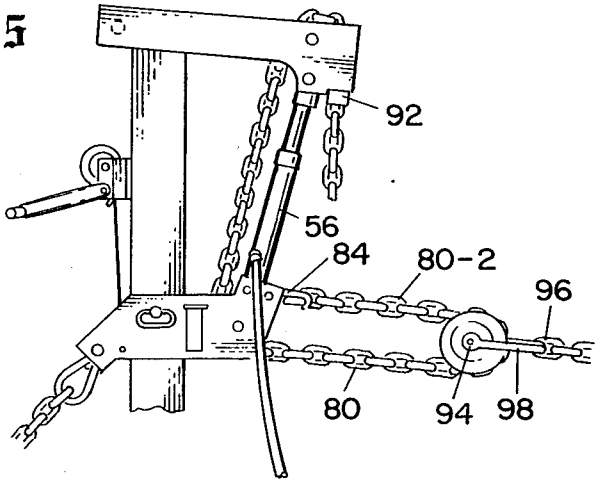
FIGS. 3, 4 and 5 illustrate arrangements for varying the effective pull obtained by the operation of the hydraulic ram.
Figure 4:
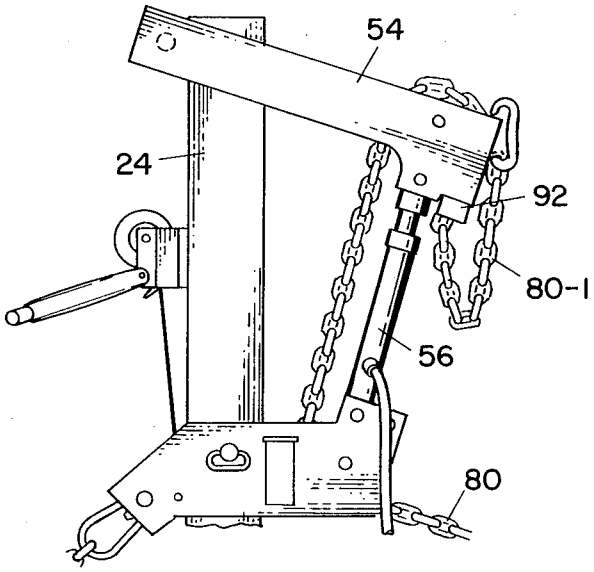
Figure 3:
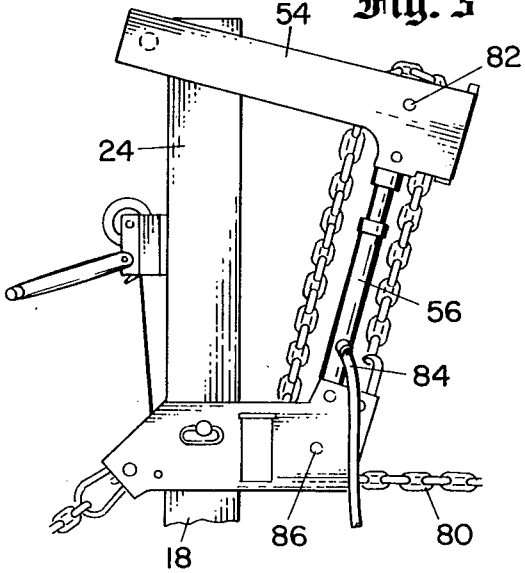

Now, proceeding to a consideration of the versatility of the unit, attention will be directed to FIGS. 3, 4 and 5. These figures deal only with variations of the pull applied to a single upper chain 80. Turning first to FIG. 3, this is the arrangement which is employed when it is desired to have a less powerful pull but one which will have a longer stroke for each actuation of the ram 56. Thus, with the ram being capable of giving a 10-ton pull, the pulley is mounted at pivot point 82 and the outer end of the chain 80 is secured to the point 84. The chain 80 therefore extends from point 84 up over the upper pulley pivoted at point 82, and down over the main pulley pivoted at point 86. With this arrangement, the lengths of chain on either side of the ram 56 are extended as the ram moves upwardly, and accordingly, the chain 80 is pulled by a distance twice the extent of the ram 56, but with only half the force. Accordingly, you get a double distance pull with the arrangement of FIG. 3, but only a five-ton pull, from the ten-ton ram 56.

In FIG. 4, however, the chain lock 92 is employed so that the portion 80-1 of the chain 80 is slack and is not effective. Accordingly, the chain 80 will be moved a distance equal to the extent of the ram 56, and a ten-ton pull is provided.

In the arrangement of FIG. 5, a supplemental pulley 94 is provided, and the chain 80 has a portion at 80-2 which is looped around pulley 94 and back to be connected to the hook 84. An additional chain 96 is connected to the right as shown in FIG. 5, to a bracket 98 secured to the pulley 94. With this arrangement, the chain 96 only moves one-half the distance of travel of the cylinder 56, and accordingly, a 20-ton pull is applied to the chain 96.

It may thus be seen that the arrangements of the present invention provide great versatility not only in the application of power selectively or together, to two different chains, but also readily and effectively provides for variation in the level of power and the amount of chain travel, desired for particular applications on a single chain. It is also to be understood that adaptations or slight variations of the arrangements shown in FIGS. 3, 4 and 5 may be employed with the dual or triple pull chain configurations of FIGS. 1 and 2. Thus, for example, an extra pulley such as that shown in FIG. 5 could be used in connection with each of chains 14 and 16 to increase the power and reduce the stroke. Similarly, in FIG. 1, with chain lock 64 in place, the chain configuration is similar to that of FIG. 3, but with increased power and reduced stroke because pulley 60 in FIG. 1 is located closer to the pivot point 126. By using chain locks at the lower surface of arm 54, in FIG. 1, and with slack in one chain, a direct pull from arm 54 to the other chain may be obtained.

It may also be noted relative to FIG. 2, that a vertical lift may be provided from the hook 102 secured to pulling arm 54-1 by the chain 104 and the clevis 106 pivotally mounted on the elongated pulling arm 54-1. Thus, if desired, the two chains 14 and 16 could be locked by the application of chain locks to the surface 108 above the bracket 48, and to the surface 110 above the bracket 52. The ram could then be lowered, and lifting accomplished with an additional chain secured to the hook 102. Of course, prior to this last step, the pulling arm 54-1 would be raised to its upper extremity, so that the portion of the chain which is adjacent to the upper pulley 62, would be slack, thus providing independence of movement for arm 54-1 from the chains 14 and 16.

The back chain 114 may also be connected through the hook 116 to the upper end of the assembly 24, to give further support when lifting action is being accomplished by the member 54-1.

It may also be noted in passing that power for the ram 56 may be provided through the high pressure line 118 extending from the air driven hydraulic pump 120.

Turning now to FIG. 6, it is a cross-sectional view taken along lines VI—VI of FIG. 2. The inner post 18 may, for example, be formed of tubing which is two inches by four inches in overall cross-sectional dimensions and has walls approximately 3/16ths inch thick. The cable guide members 42 may, for example, be formed of one-half inch square bar spaced apart by approximately one-half inch to provide clearance for the cable 32. The outer member 24 may, for example, be five inches by two and one-half inches in overall dimension and have a wall thickness of approximately 3/16ths inch.

Figure 8:
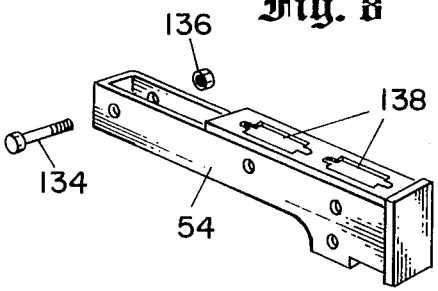
FIG. 8 is an isometric view of the pulling arm shown in FIG. 1.

FIG. 7 is an isometric view of a portion of the elongated power member 24 with its lower bracket 52. In addition, in FIG. 7, the upper bracket 124 which is employed for mounting the elongated pulling arm 54-1, is shown in some detail. In FIG. 7 the hole 126 at the upper rear portion of the member 24 is shown, and this forms the pivot point for the shorter pulling arm 54. When the bracket 124 is employed, the bolt 128 together with a second bolt 130 holds the bracket 124 rigidly in place and the arm 54-1 is pivotally mounted through the holes 132 in bracket 124. However, as shown in FIG. 8, when the shorter pulling arm 54 is employed, it is pivotally connected to the rest of assembly 24 by bolt 134 which extends through the hole 126 and is held in place by the nut 136. Incidentally, FIG. 8 shows the box-like construction of the shorter arm 54, together with cut-outs 138 to reduce the weight of the structure.

Figure 9:
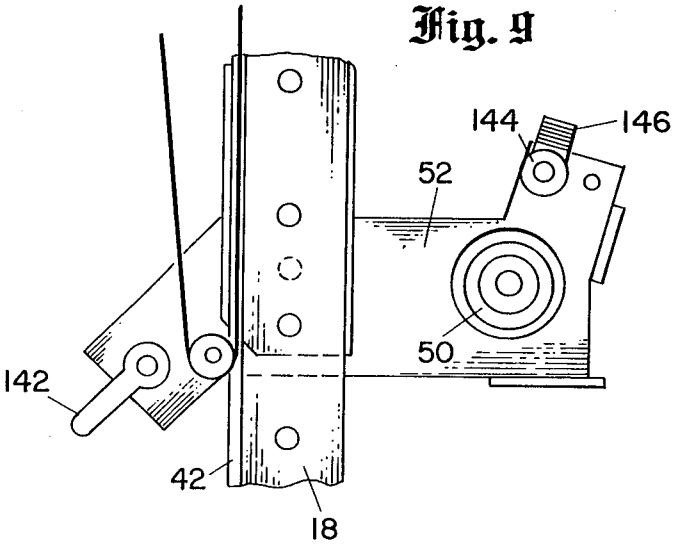
FIG. 9 is a cross-sectional view through the lower end of the power assembly in combination with its relationship to the main post.

FIG. 9 is a transverse cross-sectional view taken through bracket 52. Also shown in FIG. 9 is the main post 18, the cable guides 42, the main chain pulley 50 and the shackle member 142. FIG. 9 also shows the lower support 144 for the ram 56. It includes a cylindrical member which extends transversely between the side plates of, and is bolted to, the bracket 52, and is provided with pipe threads 146 to which the hydraulic ram may be secured.

FIGS. 10 and 11 show two views of one of the chain lock elements which may be employed to provide additional flexibility in the use of the system of the present invention. The chain lock includes two sidewalls 152 and 154 and joined by a bridging member 156 and a web 158 which is partially slotted at 160 to receive a chain link, with the web 158 extending across between walls 152 and 154 at the right-hand end of the assembly, as shown in FIG. 11. With the slanted or tapered configuration of the chain lock members, they can be forced in place to the extent necessary to securely hold the chain in its desired taut configuration, without slackening up on tightened chains.

For completeness, certain statistics may usefully be provided. For example, the power post system as shown in FIG. 1 only weighs 243 pounds without the hydraulic ram, and 254 pounds with the ram. It has been noted that the post 18 and the hollow main channel portion of power assembly 24 are formed of 3/16 inch thick steel. The power arm 54 has side walls of ½ inch steel, and the other plates thereof are ⅜ inch stock. The longer power arm 54-1 is formed from 3/16 inch steel plate.

The brackets 46, 52 and 124 have ⅜ inch thick side walls to provide adequate strength. The base 20 is formed of 2×3 inch tubing with 3/16 inch wall thickness.

In closing, it is again emphasized that the power post system of the present invention has been specially designed to provide versatility, and the multiple pulls required in the repair of damaged modern automobiles. Particularly to be noted are the possible triple pull arrangements, the flexibility in changing the power and the length of pulls which are accomplished during a single stroke of the hydraulic arm, and the light weight of the structure as compared with the immense and powerful pulls which are provided.

It is noted that the drawings and the foregoing detailed description relate to and illustrate one preferred embodiment of the invention. However, changes may be made in certain of the mechanical structures which are employed, without departing from the spirit of the invention. Thus, other beam cross-sections and other techniques for providing pivot points, chain locks, and other mechanical linkages may be employed, in place of those shown herein. Accordingly, the present invention is not limited to that precisely as shown and described hereinabove.

What is claimed is:

1. A versatile lightweight power post system for automobile repair comprising:

a hollow tubular main support post;

base means for holding said post erect;

an elongated power assembly of hollow construction movably mounted on said support post, said power assembly including a main pulley mounted toward the lower end thereof, a pulling arm pivotally mounted near the upper end thereof, hydraulic ram means coupled from the lower end of said power assembly outwardly from said post to a point on said pulling arm spaced well away from said post, and upper pulley means secured to said pulling arm for applying power to a chain extending over said main pulley;

a lower pulley slider assembly mounted on said post below said power assembly, and including a lower pulley;

first and second chain coupling means secured respectively to the lower end of said power assembly and to said lower pulley assembly, respectively, on the opposite side of said post from said pulleys; and back chain means including a continuous chain for extending through said first and second chain coupling means and through couplings associated with each of a pair of floor anchor points, said continuous chain being free to shift position at three of said couplings, to provide equalized support to said post at both of the elevations along said post where said main pulley and said lower pulley are located.

2. A system as defined in claim 1 wherein winch means is mounted on said power assembly to raise and lower said power assembly.

3. A system as defined in claim 1 including chain lock means for selectively fixing chains against movement at said pulling arm, adjacent said main pulley, and adjacent said lower pulley.

4. A system as defined in claim 1 including means for securing lifting means to said pulling arm on the outer portion of said pulling arm beyond said ram coupling point from said post.

5. A system as defined in claim 1 including means for selectively pulling on chains extending over both said main and said lower pulleys, and for locking the chains adjacent either said main or said lower pulley and continuing to pull on the chain extending over the other pulley.

6. A system as defined in claim 1 including means for increasing or reducing the force applied to chains extending over either or both said main pulley and said lower pulley.

7. A system as defined in claim 1 wherein means are provided for mounting said upper pulley from said pulling arm between the post and said ram mounting point.

8. A system as defined in claim 1 wherein means are provided for mounting said upper pulley on said pulling arm in line with said ram.

9. A versatile lightweight power post system for automobile repair comprising:

a main support post;

base means for holding said post erect;

an elongated power assembly movably mounted on said support post, said power assembly including a main pulley mounted toward the lower end thereof, a pulling arm pivotally mounted near the upper end thereof, hydraulic ram means coupled from the lower end of said power assembly outwardly from said post to a point on said pulling arm spaced well away from said post, and upper pulley means secured to said pulling arm for applying power to a chain extending over said main pulley;

a lower pulley slider assembly mounted on said post below said power assembly, and including a lower pulley;

first and second chain coupling means secured respectively to the lower end of said power assembly and to said lower pulley assembly, respectively, on the opposite side of said post from said pulleys; and back chain means connected to said first and second chain coupling means to provide support to said post at both of the elevations along said post where said main pulley and said lower pulley are located.

10. A system as defined in claim 9 wherein winch means is mounted on said power assembly to raise and lower said power assembly, said winch means including a pulley mounted on said elongated assembly near the bottom thereof, and a wire extending over said pulley and secured to the top of said post.

11. A system as defined in claim 9 including chain lock means for selectively fixing chains against movement at said pulling arm, adjacent said main pulley, and adjacent said lower pulley.

12. A system as defined in claim 9 including means for securing lifting means to said pulling arm on the outer portion of said pulling arm beyond said ram coupling point from said post.

13. A system as defined in claim 9 including means for selectively pulling on chains extending over both said main and said lower pulleys, and for locking the chains adjacent either said main or said lower pulley and continuing to pull on the chain extending over the other pulley.

14. A system as defined in claim 9 including means for increasing or reducing the force applied to chains extending over either or both said main pulley and said lower pulley.

15. A system as defined in claim 9 wherein means are provided for mounting said upper pulley from said pulling arm between the post and said ram mounting point.

16. A system as defined in claim 9 wherein means are provided for mounting said upper pulley on said pulling arm in line with said ram.

* * * * *